US007797942B2

(12) United States Patent
Saitoh et al.

(10) Patent No.: US 7,797,942 B2
(45) Date of Patent: Sep. 21, 2010

(54) GAS TURBINE COMBUSTOR HAVING MULTIPLE INDEPENDENTLY OPERABLE BURNERS AND STAGING METHOD THEREOF

(75) Inventors: Toshihiko Saitoh, Hyogo-ken (JP); Masataka Ohta, Hyogo-ken (JP); Shinji Akamatsu, Hyogo-ken (JP); Masakazu Nose, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1012 days.

(21) Appl. No.: 11/266,202

(22) Filed: Nov. 4, 2005

(65) Prior Publication Data

US 2006/0101814 A1 May 18, 2006

(30) Foreign Application Priority Data

Nov. 17, 2004 (JP) ..... 2004-332884

(51) Int. Cl.
*F02C 1/00* (2006.01)
*F02G 3/00* (2006.01)

(52) U.S. Cl. ..... 60/746; 60/776; 60/737

(58) Field of Classification Search ..... 60/733, 60/737, 738, 746, 747, 776, 39.281, 740, 60/804

See application file for complete search history.

(56) References Cited

U.S. PATENT DOCUMENTS 4,716,719 A * 1/1988 Takahashi et al. ..... 60/773
5,339,635 A * 8/1994 Iwai et al. ..... 60/733
5,349,812 A * 9/1994 Taniguchi et al. ..... 60/39.23
5,836,164 A * 11/1998 Tsukahara et al. ..... 60/733
5,899,074 A * 5/1999 Komatsu et al. ..... 60/737
5,901,555 A * 5/1999 Mandai et al. ..... 60/747
5,950,434 A 9/1999 Hums et al.
6,145,297 A 11/2000 Nagafuchi et al.

(Continued)

FOREIGN PATENT DOCUMENTS

EP 0335978 A1 11/1989

(Continued)

OTHER PUBLICATIONS

Japanese Office Action mailed Mar. 20, 2007, Application No. 2004-332884.

(Continued)

*Primary Examiner*—William H Rodríguez
(74) *Attorney, Agent, or Firm*—Westerman, Hattori, Daniels & Adrian, LLP

(57) ABSTRACT

In a combustor of a gas turbine which has a pilot nozzle being installed to the center of the axis of a combustor basket and a plurality of main nozzles being installed to the vicinity of the pilot nozzle and provided with a premixing tool on the outer circumference thereof, wherein, fuel being injected as air-fuel pre-mixture from the main nozzle into the interior of a transition piece forming a combustion chamber downstream of the combustor basket is ignited by diffusion flame being generated by the pilot nozzle in the transition piece so as to generate a premixed flame in the transition piece, wherein combustion is performed by a part of the plurality of main nozzles from start-up until a predetermined load rate and then performed by adding the remaining portion of the plurality of main nozzles when the predetermined load rate is exceeded.

7 Claims, 13 Drawing Sheets

U.S. PATENT DOCUMENTS

| | | | | |
|---|---|---|---|---|
| 6,370,863 | B2 * | 4/2002 | Muller et al. | 60/776 |
| 6,397,602 | B2 * | 6/2002 | Vandervort et al. | 60/737 |
| 6,634,175 | B1 | 10/2003 | Kawata et al. | |
| 6,666,029 | B2 * | 12/2003 | Ryan | 60/776 |
| 6,829,897 | B2 * | 12/2004 | Moriya et al. | 60/737 |
| 6,889,495 | B2 * | 5/2005 | Hayashi et al. | 60/39.37 |
| 7,284,378 | B2 * | 10/2007 | Amond et al. | 60/776 |
| 2004/0068973 | A1 * | 4/2004 | Wakabayashi et al. | 60/39.281 |
| 2007/0089395 | A1 * | 4/2007 | Fujii et al. | 60/39.281 |

FOREIGN PATENT DOCUMENTS

| | | | |
|---|---|---|---|
| EP | 1367329 | A1 | 3/2003 |
| JP | 05-156969 | A | 6/1993 |
| JP | 6-137559 | | 5/1994 |
| JP | 8-14565 | | 1/1996 |
| JP | 08-210640 | | 8/1996 |
| JP | 08-210640 | A | 8/1996 |
| JP | 09-145058 | | 6/1997 |
| JP | 09-210362 | | 8/1997 |
| JP | 09-243077 | A | 9/1997 |
| JP | 2001-073804 | | 3/2001 |
| WO | WO 89/04439 | | 5/1989 |
| WO | WO 96/41991 | A1 | 12/1996 |
| WO | WO 99/67570 | A2 | 12/1999 |
| WO | 2004/038199 | A1 | 5/2004 |

OTHER PUBLICATIONS

Chinese Office Action dated Apr. 11, 2008, issued in corresponding Chinese Patent Application No. 2005100640028 and English translation.

German Office Action dated Feb. 11, 2008, issued in corresponding German Patent Application No. 102005054442.8 and English translation.

Germany Office Action dated Apr. 15, 2010, issued in corresponding Germany Patent Application No. 10-2005-054442.8.

* cited by examiner

GAS TURBINE COMBUSTOR HAVING MULTIPLE INDEPENDENTLY OPERABLE BURNERS AND STAGING METHOD THEREOF

The present patent application is based on the Patent Application applied as 2004-332884 in Japan on Nov. 17, 2004 and includes the complete contents thereof for reference.

BACKGROUND OF THE INVENTION

1. Field of the Invention

The present invention relates to a combustor of a gas turbine and especially relates to a combustor of a gas turbine which is characterized by a staging method of fuel.

2. Description of the Prior Art

The outline of a conventional combustor of a gas turbine will be described hereinafter. FIG. 18A and FIG. 18B are schematic block diagrams showing the construction of a conventional combustor of a gas turbine; and FIG. 18A is a longitudinal cross-sectional view thereof and FIG. 18B is a figure viewed from the downstream side. As shown in FIG. 18A and FIG. 18B, a combustor of a gas turbine comprises a transition piece 10 being provided with an inner space as a combustion chamber and a combustor basket 2 being provided with a mechanism for producing air-fuel pre-mixture, wherein a pilot nozzle 3 being connected to a pilot cone 5 is installed in the center of axis of the combustor basket 2. Main nozzles 4 being connected to main burners 6 serving as pre-mixing tools are installed in the circumferential portion of the pilot nozzle 3, and in an embodiment of the present invention, eight main nozzles are installed equiangularly.

In addition, a pilot swirl 7 is installed between the pilot cone 5 and the outer circumference in the vicinity of the tip of the pilot nozzle 3; and main swirls 8 are installed between the main burners 6 and on the outer circumference of the vicinity of the tips of the main nozzles 4. Moreover, by installing a flat plate 4*a* to the side surface of the main nozzle 4 on the upstream side of the main swirl 8, a flat plate type of nozzle is employed, having fuel injection holes provided on the surface thereof. A combustor 1 is constructed as described above.

Main fuel being supplied to the main nozzles 4 produces air-fuel pre-mixture in the main burners 6. On the other hand, pilot fuel being provided to the pilot nozzle 3 generates pilot flame (diffusion flame) by the pilot nozzle 3. Then, the air-fuel pre-mixture is injected to the transition piece 10 and ignited by the pilot flame in the transition piece 10, generating a premixed flame inside the transition piece 10. In addition, a bypass elbow 9 is installed so as to protrude from the outer circumference surface of the transition piece 10 to the casing side, and a bypass valve "BV" is installed to the tip thereof.

For the rest, a combustor of a gas turbine which uniforms the mixture of the air and the fuel gas in the radial direction in the main nozzles and reduces the amount of diffusion combustion in the pilot combustion chamber so as to advance reduction of NOx is disclosed in the Patent Application Laid Open No. H6-137559. Additionally, a combustion equipment of a gas turbine which has high combustion efficiency although combustion is partial so as to increase the ratio of premixed combustion generating a small amount of NOx as well as which can achieve stable combustion when the density of fuel of the air-fuel pre-mixture is low and achieve combustion with NOx reduced in a wide load zone is disclosed in the Patent Application Laid Open No. H8-14565.

Conventionally, for a combustor of a gas turbine, stable combustion and combustion in a low environmental load have been searched for in a wide range of load condition from a partial load to a full load. However, because the conventional combustor of a gas turbine as described hereinabove applies lean pre-mixed combustion due to reduction of NOx, the fuel is relatively diluted in order to achieve low combustion temperature at the time of partial load, resulting in generation of a large amount of unburned portion of the fuel. Reduction of the unburned portion of the fuel at the time of partial load is an important issue for the market needs.

Therefore, in order to reduce such unburned portion of the fuel as described hereinabove, the operational parameters are set in a manner that the pilot fuel ratio is set high and the bypass valve is opened. However, the upper limit of the pilot fuel ratio is limited by the fuel pressure, and also the upper limit of the ratio of fuel versus air is limited in the combustion area due to the size of the bypass valve. Moreover, because in the existing operational mode, fuel is supplied to all the main nozzles (eight nozzles in the above-mentioned example of a conventional combustor) and the pilot nozzle (one nozzle) since start-up, naturally, reduction of the unburned portions comes to be limited if nothing is done.

Additionally, the conventional control method of combustion has a tendency to deteriorate the property of exhaust gas and generate combustion vibration and further, an increase in metal temperature of the combustor when the load is low, which needs to be improved.

SUMMARY OF THE INVENTION

It is an object of the present invention to provide a combustor of a gas turbine which can reduce the unburned portion of a fuel at the time of partial load so as to enhance the characteristics of exhaust gas and can achieve combustion stably, by improving the staging method of the fuel.

According to the present invention, in order to achieve the above-mentioned object, a combustor of a gas turbine includes a pilot nozzle being installed to the center of the axis of a combustor basket and a plurality of main nozzles being installed to the vicinity of the pilot nozzle and provided with a pre-mixing tool on the outer circumference thereof; wherein the fuel being injected as the air-fuel pre-mixture from the main nozzles to the inside of the transition piece forming a combustion chamber downstream of the combustor basket is ignited by diffusion flame being generated by the pilot nozzle in the transition piece so as to generate a premixed flame in the transition piece; and wherein, combustion is performed by a part of the plurality of main nozzles from start-up to a predetermined ratio of load and then, when the load is over the predetermined ratio, combustion is performed by the plurality of main nozzles including the remaining main nozzles added.

Additionally, when the load is over the predetermined ratio, combustion is carried out by adding the remaining main nozzles one by one in accordance with an increase in load. Moreover, pilot holes are provided to the pilot nozzle, corresponding to the plurality of main nozzles respectively, so that in order to respond to combustion performed by each of the main nozzles respectively, the fuel is injected from the pilot holes respectively.

In addition, a top hat fuel nozzle is installed so as to supply the fuel to the pilot nozzle side. Furthermore, the top hat fuel nozzle is provided to each of the plurality of main nozzles respectively so as to inject the fuel from each of the top hat fuel nozzles respectively, responding to combustion being performed by each of the main nozzles respectively.

For the rest, a combustor of a gas turbine includes a pilot nozzle being installed to the center of the axis of a combustor basket and a plurality of main nozzles being installed to the vicinity of the pilot nozzle and provided with a pre-mixing tool on the outer circumference thereof, wherein the fuel being injected as the air-fuel pre-mixture from the main nozzles to the inside of the transition piece forming a combustion chamber downstream of the combustor basket is ignited by diffusion flame being generated by the pilot nozzle in the transition piece so as to generate a premixed flame in the transition piece; and wherein, a nozzle for oil injection being installed to the pilot nozzle can be replaced with a nozzle for gas injection.

Additionally, a combustor of a gas turbine includes a pilot nozzle being installed to the center of the axis of a combustor basket and a plurality of main nozzles being installed to the vicinity of the pilot nozzle and provided with a pre-mixing tool on the outer circumference thereof; wherein the fuel being injected as air-fuel pre-mixture from the main nozzles to the inside of the transition piece forming a combustion chamber downstream of the combustor basket is ignited by diffusion flame being generated -by the pilot nozzle in the transition piece so as to generate a premixed flame in the transition piece; and wherein, a cap for water atomizing which is installed to the pilot nozzle can be replaced with a cap for gas injection.

Moreover, a combustor of a gas turbine includes a pilot nozzle being installed to the center of the axis of a combustor basket and a plurality of main nozzles being installed to the vicinity of the pilot nozzle and provided with a pre-mixing tool on the outer circumference thereof, wherein the fuel being injected as the air-fuel pre-mixture from the main nozzles to the inside of the transition piece forming a combustion chamber downstream of the combustor basket is ignited by diffusion flame being generated by the pilot nozzle in the transition piece so as to generate a premixed flame in the transition piece; and wherein, the apical surface of the pilot nozzle is provided with catalyst coating.

DESCRIPTION OF THE PREFERRED EMBODIMENTS

Figure 1:
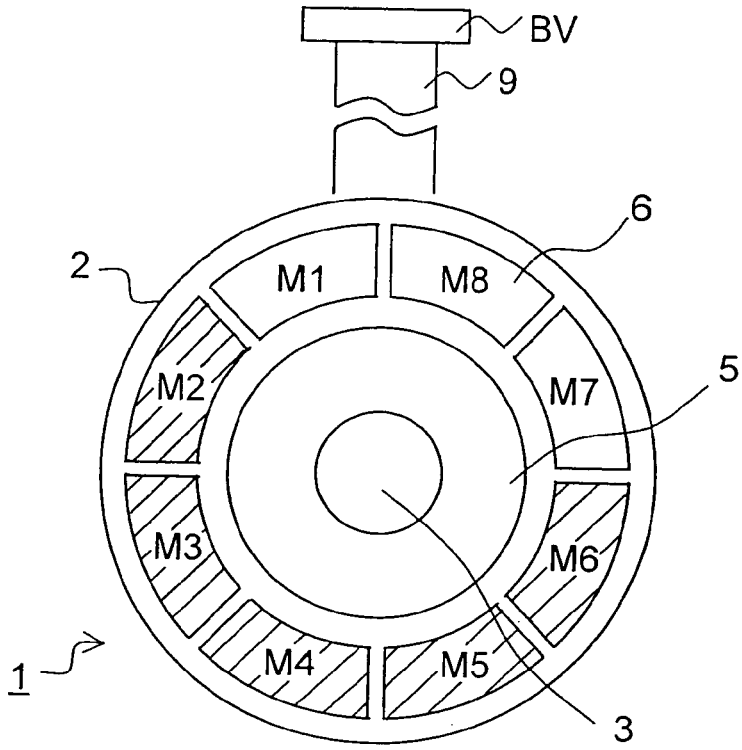
FIG. 1 is a schematic view of a combustor of a gas turbine viewed from the downstream side in accordance with a first embodiment of the present invention.

Referring now to the drawings, an embodiment of the present invention will be described as follows. Same symbols will be supplied to the portions that are common to the example of a conventional combustor of a gas turbine and detailed explanation will be omitted accordingly.

First Embodiment

Figure 18A:
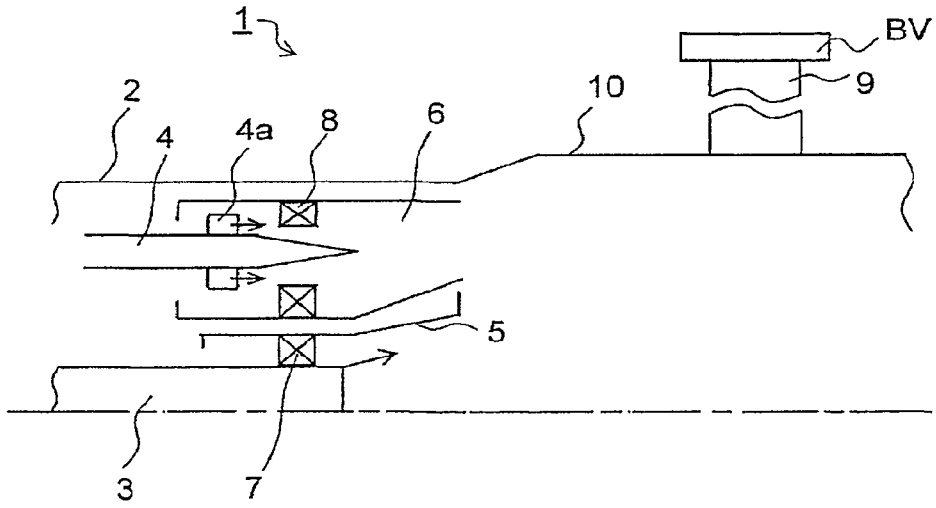
FIG. 18A PRIOR ART
FIG. 18A and FIG. 18B are schematic block diagrams showing the construction of a conventional combustor of a gas turbine.
Figure 18B:
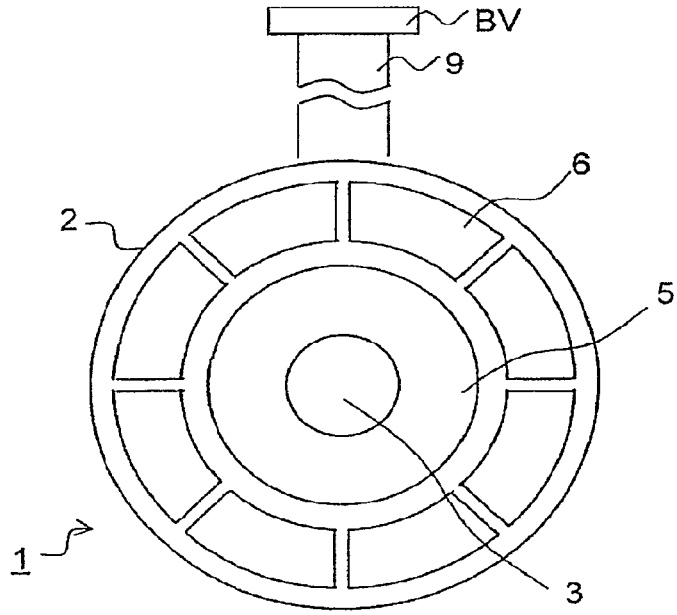
FIG. 18B PRIOR ART

FIG. 1 is a schematic view showing a combustor of a gas turbine viewed from downstream side in accordance with a first embodiment of the present invention. Same as the example of a conventional combustor of a gas turbine shown in FIG. 18A and FIG. 18B, FIG. 1 illustrates a combustor having eight main nozzles and one pilot nozzle. This is the same with each of the following embodiments. In FIG. 1, the main nozzles 4 being connected to each of main burners 6 (not illustrated herein) are supplied with symbols from M1 through M8 sequentially counterclockwise, starting with the main nozzle on the side of the bypass elbow 9; wherein, for example, combustion is performed in the low load zone only by five main nozzles M2 through M6 being shown with slanting lines and located apart from a bypass elbow 9, and in the partial load zone, combustion is changed over so as to be performed by all the eight main nozzles M1 through M8 by adding the remaining three main nozzles. However, the amount of the entire main fuel supply will not be changed.

Figure 2:
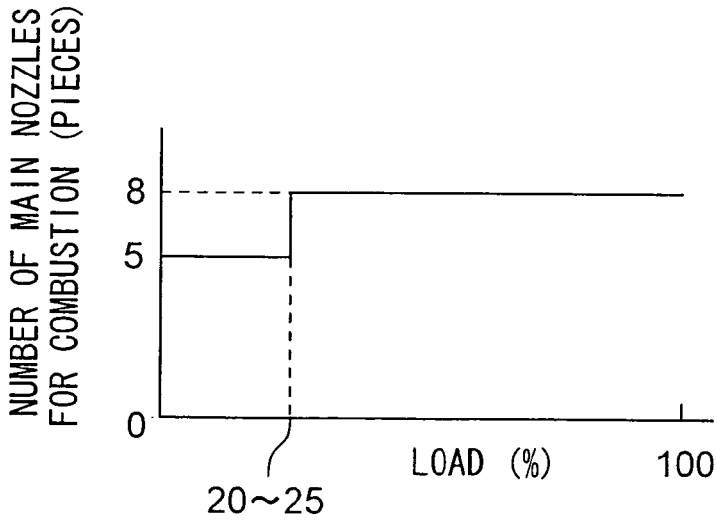
FIG. 2 is a graph showing the staging of fuel in accordance with the first embodiment.

FIG. 2 is a graph showing the staging of the fuel in accordance with the first embodiment. Here, the axis of abscissas shows the load (%) and the axis of ordinate shows the number of the main nozzles performing combustion (in pieces). As shown in FIG. 2, for an example, in the low load zone where the load is lower than 20% to 25%, combustion is performed by a part of the main nozzles, namely five main nozzles; and in the partial load zone where the load is 20 to 25% or higher, combustion is changed over so as to be performed by the eight main nozzles by adding the remaining three main nozzles.

By performing combustion with five main nozzles in the low load zone as described above, the density of the air-fuel pre-mixture is increased, thereby reducing the unburned portion. Additionally, combustion vibration is restrained by performing combustion at a position being asymmetric against the central axis of a combustor. Moreover, by installing three main nozzles (M1, M7 and M8 in this example) that do not perform combustion to the side of the bypass elbow 9, the combustion gas is prevented from being introduced into the bypass elbow 9.

In addition, although the number of the main nozzles is not limited to five to perform combustion and combustion is performed by one main nozzle or by three main nozzles and the like, such combustion is possible as has much density of the air-fuel pre-mixture and is asymmetric against the central axis. However, from a point of view of executing effective combustion while restraining other defects such as, for example, an increase in metal temperature, flashback and the like, combustion performed by five main nozzles is the most practical in the existing circumstances.

The swirling direction of the air-fuel pre-mixture by the main swirls 8 is anticlockwise in FIG. 1. Therefore, in addition to the main nozzles M1 and M8 being located closest to the bypass elbow 9 and symmetrically installed, the main nozzle 7 being adjacent clockwise thereto will not perform combustion, thereby making the combustion gas swirling counterclockwise be apart from the bypass elbow 9. As a result, the combustion gas is surely prevented from being introduced into the bypass elbow 9.

Additionally, by supplying a layer of catalyst such as honeycomb construction and the like, for example, to each of the main burners 6 being connected to each of the main nozzles (M2 through M6 in this embodiment) that perform combustion in the low load zone, the combustion in the low load zone is facilitated so as to ensure reduction of the unburned portion of the fuel.

Second Embodiment

Figure 3:
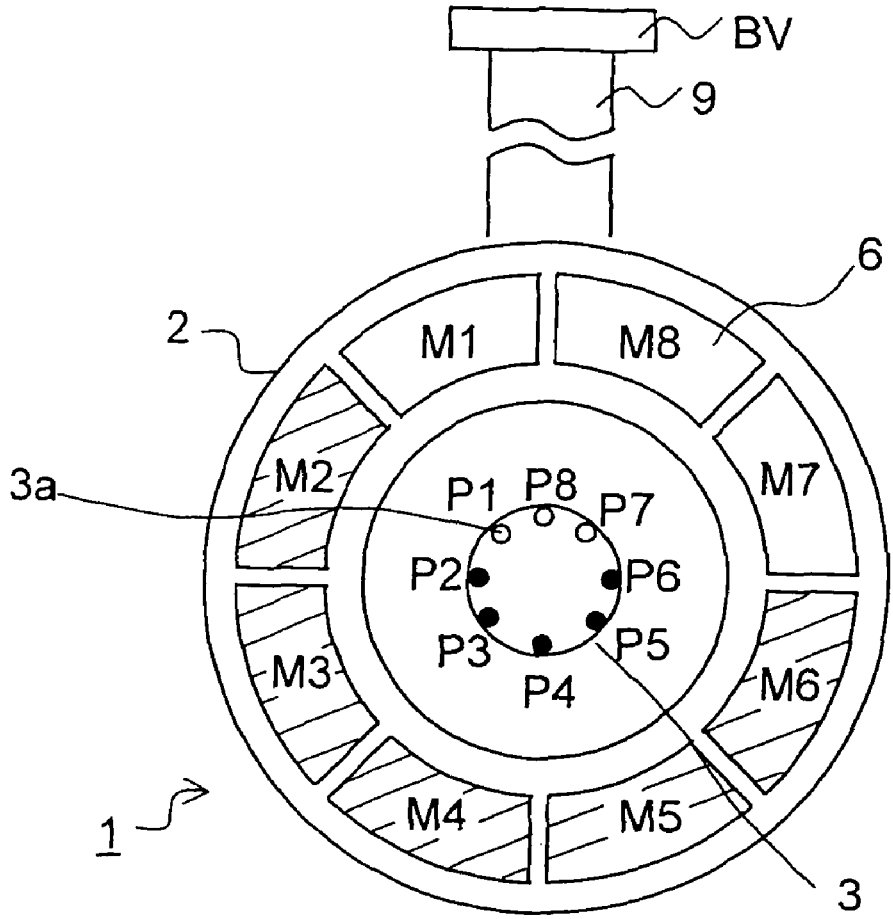
FIG. 3 is a schematic view of a combustor of a gas turbine viewed from the downstream side in accordance with a second embodiment of the present invention.

FIG. 3 is a schematic view showing a combustor of a gas turbine viewed from downstream side in accordance with the second embodiment of the present invention. In this embodiment, in addition to the construction of the above first embodiment, a plurality of pilot holes 3*a* (eight holes in FIG. 3) being provided to the circumference of the tip of the pilot nozzle 3 implement the staging of the fuel in accordance with the behavior of the main nozzles 4.

As shown in FIG. 3, the pilot holes 3a are opened so as to be located between each of the main nozzles, being viewed from the central axis. Then, to each of the pilot holes 3*a*, symbols P1 through P8 are provided counterclockwise sequentially, starting with the pilot hole 3*a* being positioned between the main nozzles M1 and M2. Wherein, when combustion is performed in the low load zone, for example, by the five main nozzles M2 through M6 shown with slanting lines, the fuel is injected only from the corresponding five holes (shown with black circles) P2 through P6, and then, after changing over combustion so as to be performed by all the eight main nozzles M1 through M8 in the partial load zone, the fuel is injected from all the eight corresponding holes P1 through P8.

Figure 4A:
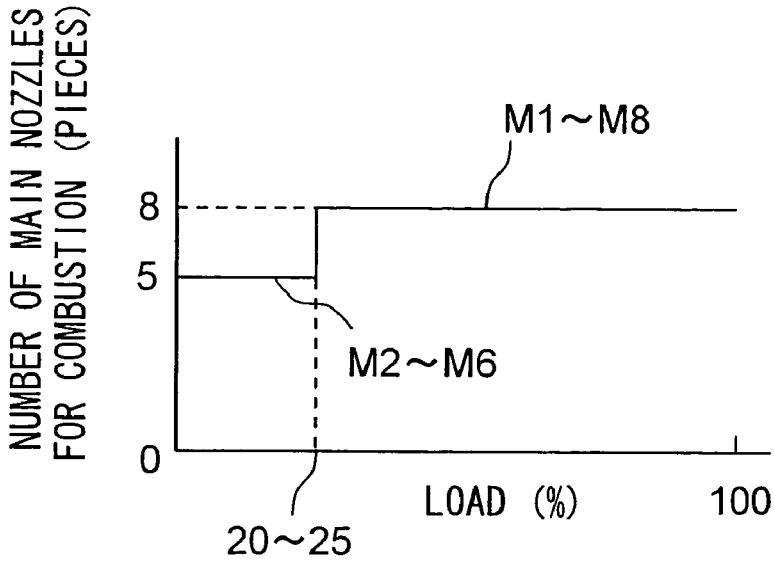
FIG. 4A and FIG. 4B are graphs showing the staging of fuel in accordance with the second embodiment.
Figure 4B:
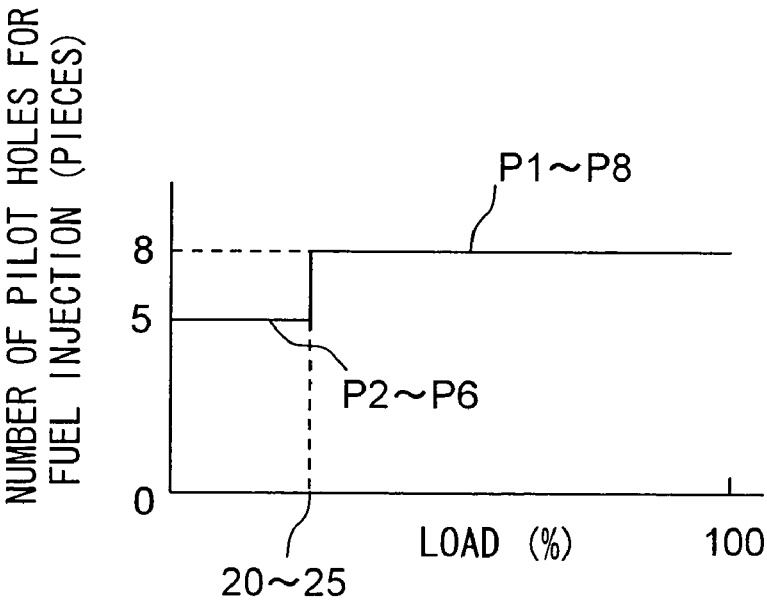

FIG. 4A and FIG. 4B are graphs showing the staging of the fuel in accordance with the second embodiment. FIG. 4A shows the staging of the main fuel and FIG. 4B shows the staging of the pilot fuel. In FIG. 4A, the axis of abscissas shows the load (%) and the axis of ordinate shows the number of the main nozzles performing combustion (in pieces). Also, in FIG. 4B, the axis of abscissas shows the load (%) and the axis of ordinate shows the number of pilot holes for fuel injection (in pieces).

As shown in FIG. 4A, in the low load zone where the load is lower than 20% to 25%, combustion is performed by the five main nozzles M2 through M6; and in the partial load zone where the load is 20 to 25% or higher, combustion is performed by changing over to the eight main nozzles M1 through M8. As shown in FIG. 4B, in responding to the combustion as described hereinabove, in the low load zone where the load is lower than 20% to 25%, the fuel is injected only from the five holes P2 through P6; and in the partial load zone where the load is 20 to 25% or higher, the fuel is injected from all the eight holes P1 through P8. By responding to the five main nozzles which perform combustion in the low load zone and by injecting the fuel from the five pilot holes as described hereinabove, combustion can be performed more effectively, thereby reducing the unburned portion of the fuel.

In addition, the pilot holes P1 through P8 corresponding to each of the main nozzles M1 through M8 are slightly drifted from each other (for 22.5 degrees, for example) counterclockwise in FIG. 3. This is for combustion to be performed effectively by making it easy for the pilot flame to come to the downstream side of the corresponding main nozzle because the swirling direction of the pilot combustion gas by the pilot swirl 7 is clockwise in FIG. 3. In this regard, the position of each of the pilot holes corresponding to each of the main nozzles can be changed arbitrarily, responding to changes in the angle of the main swirls, in the angle of the pilot swirl and further, in the construction of the combustor and the like.

Third Embodiment

Figure 5A:
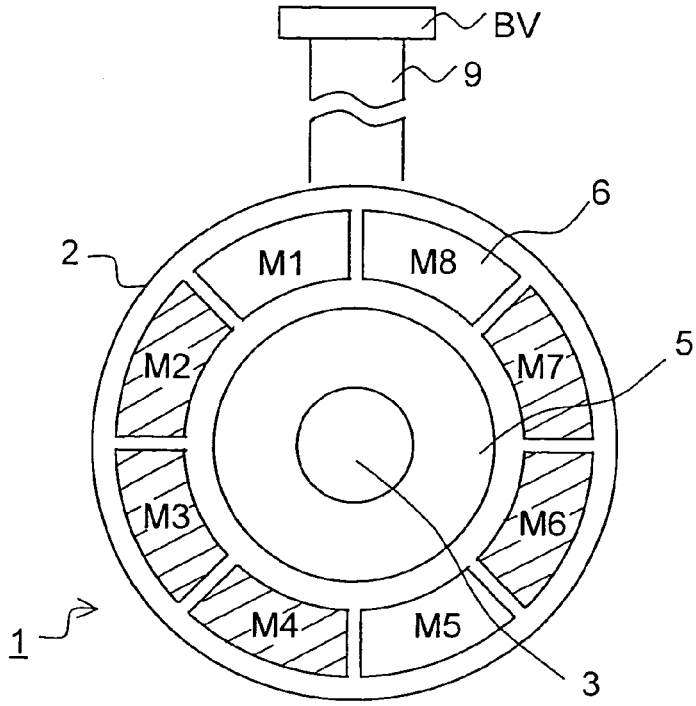
FIG. 5A and FIG. 5 are schematic views of a combustor of a gas turbine viewed from the downstream side in accordance with a third embodiment of the present invention.
Figure 5B:
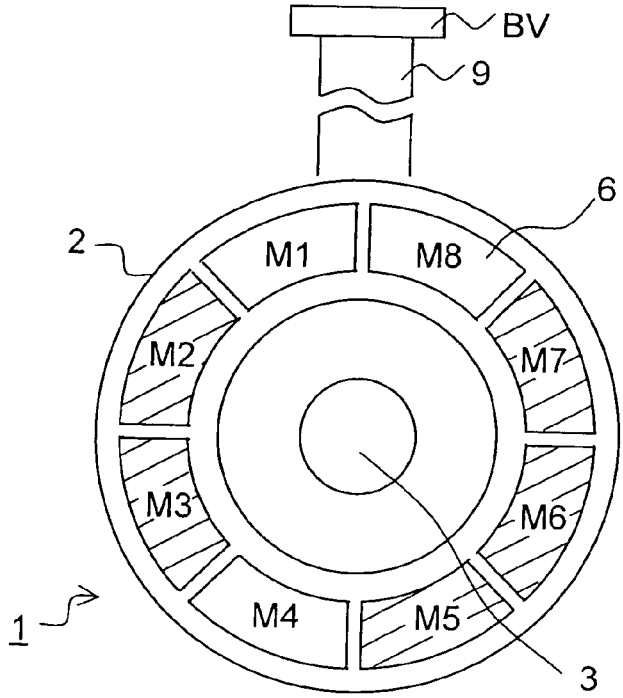

FIG. 5A and FIG. 5B are schematic views showing a combustor of a gas turbine viewed from downstream side in accordance with the third embodiment of the present invention. For the construction of the above first embodiment, a combustor in accordance with the third embodiment is constructed in a manner that the main nozzles performing combustion in the low load zone are distributed to some extent. For example, as shown in FIG. 5A with slanting lines, in the low load zone, combustion may be performed by the main nozzles M2 through M4, M6 and M7 but may not be performed by the main nozzle M5 therebetween. Or, as shown in FIG. 5B with slanting lines, in the low load zone, combustion may be performed by the main nozzles M2, M3 and M5 through M7 but may not be performed by the main nozzle M4 therebetween. In addition, because the main nozzles M1 and M8 are on the side of the bypass elbow 9, in order to prevent inclusion of combustion gas, combustion will not be performed in the low load zone either in the case of FIG. 5A or the case of FIG. 5B.

As the third embodiment, when the main nozzles performing combustion in the low load zone are divided into two, namely three main nozzles and two main nozzles, combustion efficiency may possibly deteriorate slightly, compared with the first embodiment, wherein five main nozzles are completely adjacent to each other. To be more precise, in FIG. 5A, there is a possibility that combustion efficiency may deteriorate in the vicinity of the main nozzle M5; and in FIG. 5B, combustion efficiency may deteriorate in the vicinity of the main nozzle M4. However, compared with the case where combustion is performed by all the eight main nozzles, combustion efficiency is improved, and additionally, non-uniform distribution of the combustion gas temperature in the circumferential direction is improved better than the first embodiment, resulting in having more advantages than the first embodiment.

Fourth Embodiment

Figure 6:
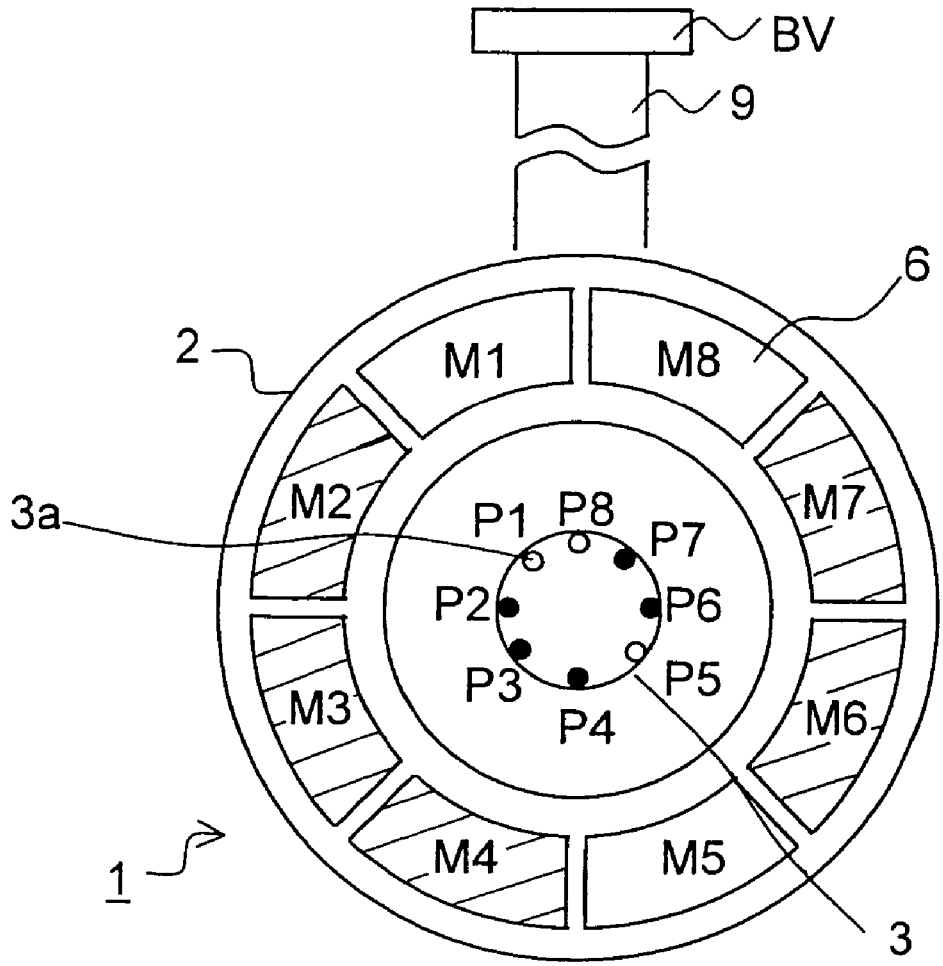
FIG. 6 is a schematic view of a combustor of a gas turbine viewed from the downstream side in accordance with a fourth embodiment of the present invention.

FIG. 6 is a schematic view showing a combustor of a gas turbine viewed from the downstream in accordance with the fourth embodiment of the present invention. In this fourth embodiment, in addition to the construction of the above third embodiment, the pilot holes 3*a* implement the staging in accordance with the behavior of the main nozzles 4 in the same manner as the second embodiment. To be more precise, when combustion is performed, for example, by the five main nozzles M2 through M4, M6 and M7 shown with slanting lines in the low load zone, the fuel is injected only from the corresponding five holes P2 through P4, P6 and P7 (shown with a black circle). Then, after changing over the combustion to be performed by all the eight main nozzles M1 through M8 in the partial load zone, the fuel is injected from all the eight corresponding holes P1 through P8.

Figure 7A:
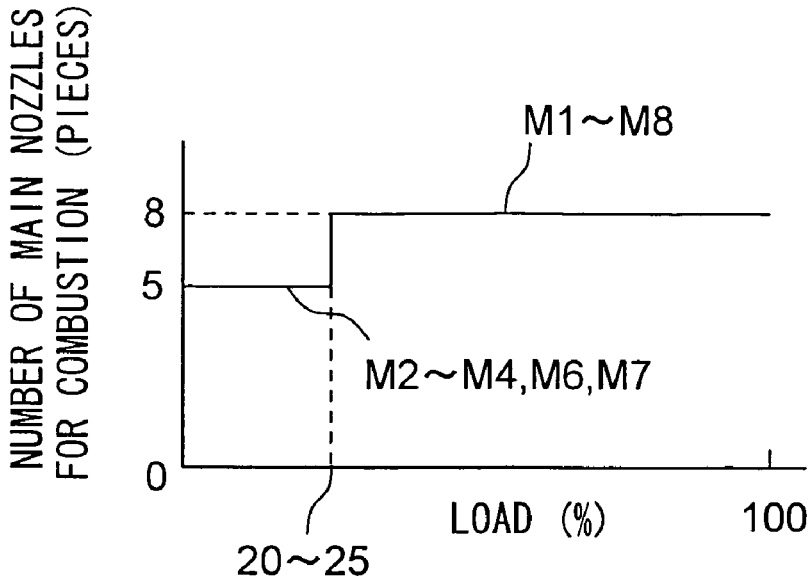
FIG. 7A and FIG. 7B are graphs showing the staging of fuel in accordance with the fourth embodiment.
Figure 7B:
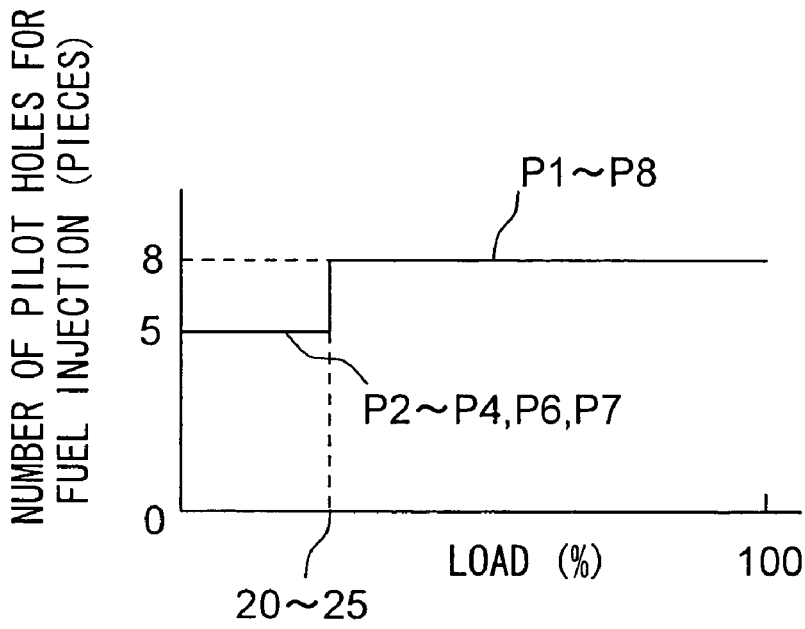

FIG. 7A and FIG. 7B are graphs showing the staging of the fuel in accordance with the fourth embodiment. FIG. 7A shows the staging of the main fuel, and FIG. 7B shows the staging of the pilot fuel. In FIG. 7A, the axis of abscissas shows the load (%) and the axis of ordinate shows the number of the main nozzles performing combustion (in pieces). Also, in FIG. 7B, the axis of abscissas shows the load (%) and the axis of ordinate shows the number of pilot holes for fuel injection (in pieces).

As shown in FIG. 7A, combustion is performed by the five main nozzles M2 through, M4, M6 and M7 in the low load zone where the load is lower than 20% to 25%, and in the partial load zone where the load is 20 to 25% or higher, combustion is performed by changing over to the eight main nozzles M1 through M8. In response to this, as shown in FIG. 7B, in the low load zone where the load is lower than 20% to 25%, the fuel is injected only from the five holes P2 through P4, P6 and P7, and in the partial load zone where the load is 20 to 25% or higher, the fuel is injected from all the eight holes P1 through P8.

By injecting the fuel from the five pilot fuel holes in response to the five main nozzles which perform combustion in the low load zone, combustion can be performed more effectively, thereby reducing the unburned portion of the fuel. In addition, an example dealing with the construction having the main nozzles as shown in the above FIG. 5A is described herein, but it is the same with a case dealing with the construction of FIG. 5B. Wherein, in the low load zone, the fuel is injected only from the five holes P2, P3 and P5 through P7, and in the partial load zone, the fuel is injected from all the eight holes P1 through P8.

Fifth Embodiment

Figure 8:
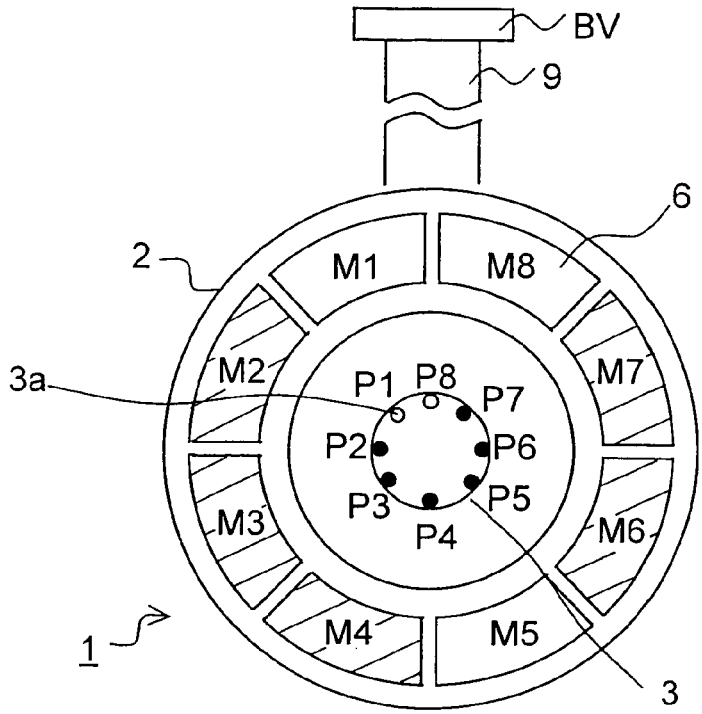
FIG. 8 is a schematic view of a combustor of a gas turbine viewed from the downstream side in accordance with a fifth embodiment.

FIG. 8 is a schematic view showing a combustor of a gas turbine viewed from the downstream side in accordance with the fifth embodiment of the present invention. In this embodiment, in addition to the construction of the above fourth embodiment, the fuel is injected from the pilot hole P5 corresponding to the main nozzle M5 that does not perform combustion in the low load zone. To be more precise, in the low load zone, when combustion is performed, for example, by the five main nozzles M2 through M4, M6 and M7 indicated with slanting lines, the fuel is injected from the six holes (indicated with black circles) including the holes P2 through P4, P6 and P7 corresponding to the main nozzles and the hole P5 being added hereto.

Then, after changing over the combustion so as to be performed by all the eight main nozzles M1 through M8 in the partial load zone, the fuel is injected through all the eight corresponding holes P1 through P8. Being constructed as described above, it is possible to enhance the combustion efficiency of the flames of the main nozzles M4 and M6 on the side of the main nozzle M5, respectively. Moreover, by being constructed so as to inject the fuel from the pilot holes P1 and P8 corresponding to the main nozzles M1 and M8 that do not perform combustion in the low load zone, it is also possible to enhance the combustion efficiency of the flame of the main nozzle M2 on the side of the main nozzle M1 as well as the combustion efficiency of the flame of the main nozzle M7 on the side of the main nozzle M8.

Sixth Embodiment

In the sixth embodiment, for the construction of the above first embodiment, combustion is performed only by the five main nozzles M2 through M6 in the same manner as explained for FIG. 1 during start-up, and then performed by adding the main nozzles one by one in accordance with an increase in the load. To be more precise, the fuel is supplied sequentially to the main nozzles that are adjacent to the main nozzles M2 through M6 having performed combustion from the beginning. In this embodiment, for example, the fuel is supplied to the main nozzle M1, then to the main nozzle M7 and then to the main nozzle M8.

Figure 9:
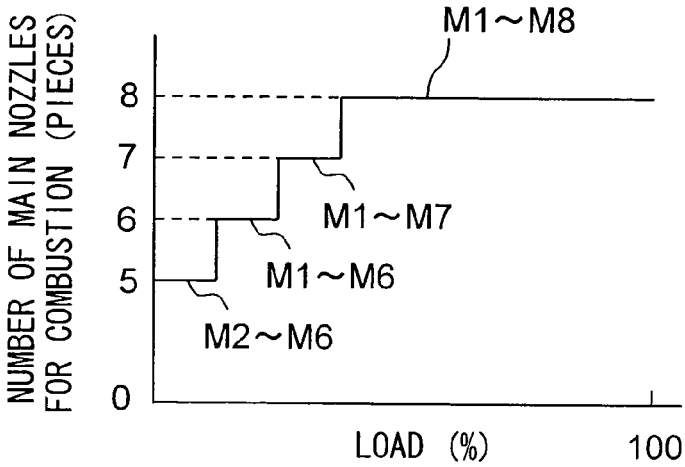
FIG. 9 is a graph showing the staging of fuel in accordance with a sixth embodiment.

FIG. 9 is a graph showing the staging of the fuel in accordance with the sixth embodiment. Here, the axis of abscissas shows the load (%) and the axis of ordinate shows the number of the main nozzles performing combustion (in pieces). As shown in FIG. 9, combustion is performed by the five main nozzles M2 through M6 from the start-up until the predetermined load rate, and as the load increases, the main nozzles will be added for combustion sequentially, in the order from M1 to M7 and then to M8. As a result, combustion can be performed effectively, thereby reducing the unburned portion of the fuel.

In addition, the sequence of addition of the main nozzles M1 and M7 may be reversed. However, it is desirable to make the construction to be such as the main nozzle M8 is finally added. This is for preventing the combustion gas from being introduced into the bypass elbow 9 as much as possible by adding the main nozzle M8 at the end in which the combustion gas swirling counterclockwise comes closest to the bypass elbow 9 because the swirling direction of the air-fuel pre-mixture by the main swirls 8 is anticlockwise in FIG. 1.

Seventh Embodiment

In the seventh embodiment, in addition to the construction of the above sixth embodiment, same as the construction of the above second embodiment, the pilot holes in the circumference of the tip of the pilot nozzle implement the staging in accordance with the behavior of the main nozzles. However, in this embodiment, when the main nozzles are added to perform combustion, first the pilot holes are added and then the corresponding main nozzles will be added.

Figure 10A:
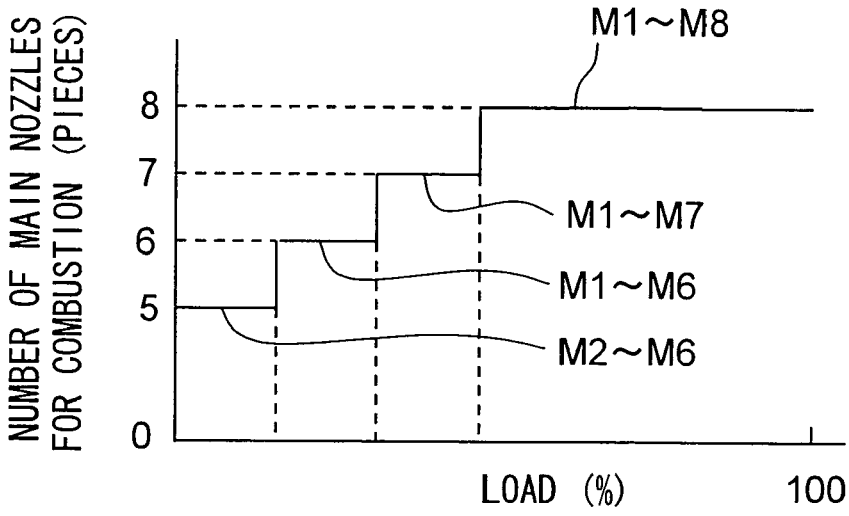
FIG. 10A and FIG. 10B are graphs showing the staging of fuel in accordance with a seventh embodiment.
Figure 10B:
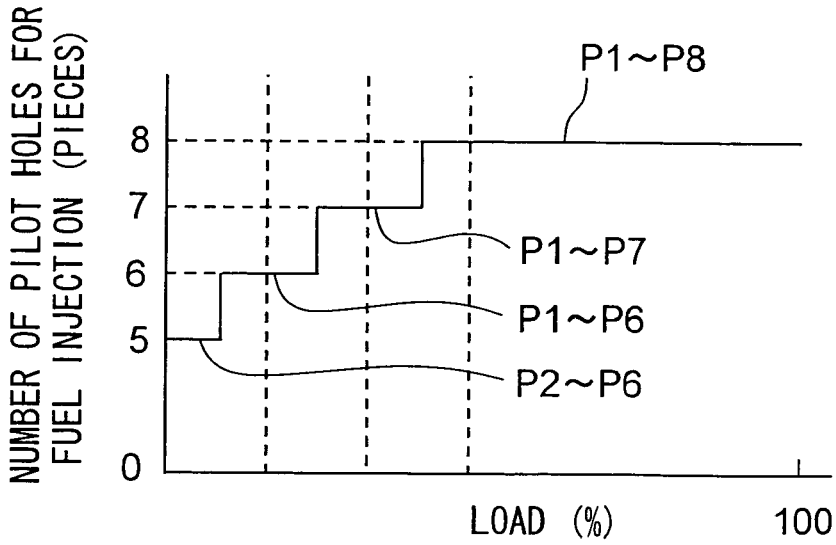

FIG. 10A and FIG. 10B are graphs showing the staging of the fuel in accordance with the seventh embodiment. FIG. 10A shows the staging of the main fuel, and FIG. 10B shows the staging of the pilot fuel. In FIG. 10A, the axis of abscissas shows the load (%) and the axis of ordinate shows the number of the main nozzles performing combustion (in pieces). Additionally, in FIG. 10B, the axis of abscissas shows the load (%) and the axis of ordinate shows the number of pilot holes for fuel injection (in pieces).

As shown in FIG. 10A, combustion is performed by the five main nozzles M2 through M6 from the start-up until the predetermined load rate, and as the load increases, the main nozzles will be added for combustion sequentially, in the order from M1 to M7 and then to M8. In response to this, as shown in FIG. 10B, the fuel is injected only from the five holes P2 through P6 from the start-up until the predetermined load rate, and prior to sequential addition of each of the main nozzles M1, M7 and M8 respectively, the fuel is injected in sequence from the corresponding holes P1, P7 and P8.

As a result, it is ensured that the pilot fire can be formed before addition of the main nozzles, thereby restraining unstable combustion and the like when the main nozzles are added. In addition, in accordance with addition of each of the main nozzles, the fuel may be injected from each of the pilot holes simultaneously, which is effective for reduction of the unburned portion of the fuel due to staging of the fuel, which is the object of the present invention.

Eighth Embodiment

Figure 11:
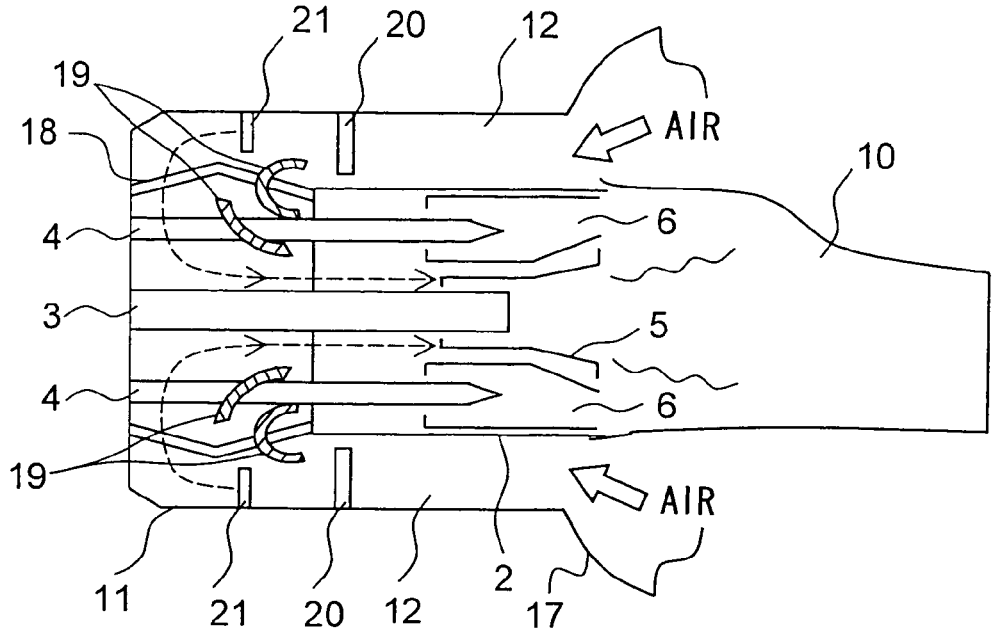
FIG. 11 is a schematic longitudinal cross-sectional view showing a combustor of a gas turbine in accordance with an eighth embodiment.

FIG. 11 is a schematic longitudinal cross-sectional view showing a combustor of a gas turbine in accordance with the eighth embodiment of the present invention. As shown in FIG. 11, a combustor in accordance with this embodiment includes a transition piece 11 and a combustor basket 2 being surrounded thereby concentrically and has a pilot nozzle 3 installed to the position of the center of axis of the combustor basket 2. The main nozzles 4 being connected to the main burners 6 are installed in the surrounding area of the pilot nozzle 3, wherein the combustor basket 2 is connected to the transition piece 10 at the posterior end thereof In addition, between the combustor basket 2 and the transition piece 11 surrounding the combustor basket 2 is formed an air passageway 12, wherein the existing top hat fuel nozzles 20 are installed, standing around the inner circumference wall of the transition piece 11. Then, the fuel is mixed with the air which is supplied through the air passageway 12 (shown with an outline arrow) so as to sufficiently maintain the distance to the combustion area being formed by the wake flow, thereby obtaining uniform air-fuel mixture. In addition, the number "17" is the casing where the transition piece 11 is installed penetrating through, and the number "18" is a strut which fixes the combustor basket 2 to the transition piece 11.

Moreover, in this embodiment, as shown in FIG. 11, on the downstream side of the air flow of the existing top hat fuel nozzle 20 is installed a second top hat fuel nozzle 21 being shorter than the existing top hat fuel nozzle 20, so that the second top hat fuel being injected from the second top hat fuel nozzle 21 goes around the outside of the turning vane 19 being supplied from the air passageway 12 to the combustion basket 2 as shown with an arrow in a broken line, so as to be supplied to the side of the pilot nozzle 3. By using the top hat fuel nozzle 21, a large volume of fuel can be supplied to the pilot circulation portion, thereby reducing the unburned portions of the fuel.

Figure 12:
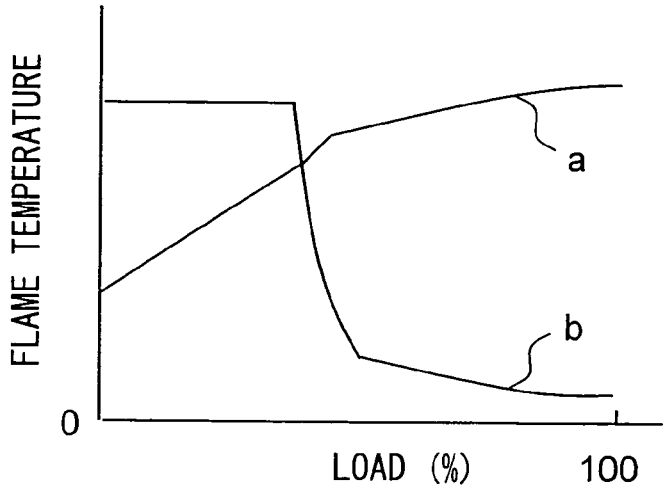
FIG. 12 is a graph showing an example of a schedule of combustion in accordance with the eighth embodiment.

FIG. 12 is a graph showing an example of a schedule of combustion in accordance with this embodiment. In FIG. 12, the axis of abscissas shows the load (%), and the axis of ordinate shows the flame temperature. In addition, the curve "a" in the figure shows the temperature of the main flame, and the curve "b" shows the temperature of the pilot flame. As shown in FIG. 12, when the load is low, combustion is performed by appropriately adjusting the pilot fuel ratio and the above second top hat fuel ratio and maintaining the pilot flame temperature range necessary for flame stabilizing and reduction of the unburned portion of the fuel.

Then, when the combustion temperature becomes relatively high at the intermediate load (for example, at approximately 50% load), the mode is changed over to the normal low NOx mode, more specifically, the mode using the main nozzles, the pilot nozzle and the existing top hat fuel nozzles. Afterwards, in accordance with an increase in the load, the temperature of the pilot flame rapidly descends, while the temperature of the main flame gradually ascends.

Ninth Embodiment

In this embodiment, in place of installing the second top hat fuel nozzle 21, for example, the existing top hat fuel nozzle 20 has injection holes (not illustrated)) installed for two systems injecting the fuel to the exterior and the interior of the inside of the combustion basket 2 respectively, so as to separate the outside injection hole from which the fuel flows to the pilot side as another system. Then, by being constructed so as to inject the fuel from this outside injection hole at the time of partial load, same effects can be obtained as when the second top hat fuel nozzle is installed as the above eighth embodiment, and moreover, cost reduction can be achieved by decreasing the number of components of the combustor.

Tenth Embodiment

In the tenth embodiment, the above second top hat fuel nozzle 21 or another system of the top hat fuel nozzle 20 are installed in the circumferential direction of the combustor as T1 through T8, for example, so as to correspond to the above main nozzles M1 through M8. Then, in accordance with the staging of the main nozzles as shown in the above first and the sixth embodiments and the like, the top hat fuel nozzles implement staging. By this, the temperature of the local flame more can be increased effectively, thereby reducing the unburned portion of the fuel.

Figure 13A:
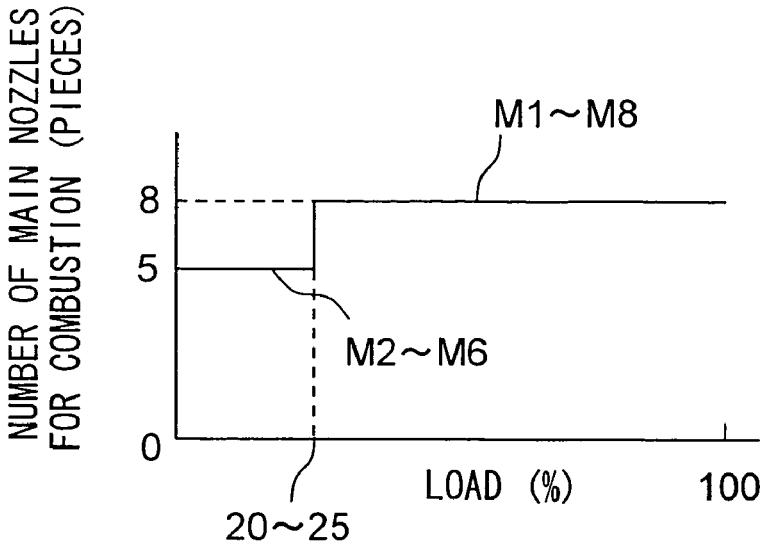
FIG. 13A and FIG. 13B are graphs showing an example of the staging of fuel in accordance with a tenth embodiment.
Figure 13B:
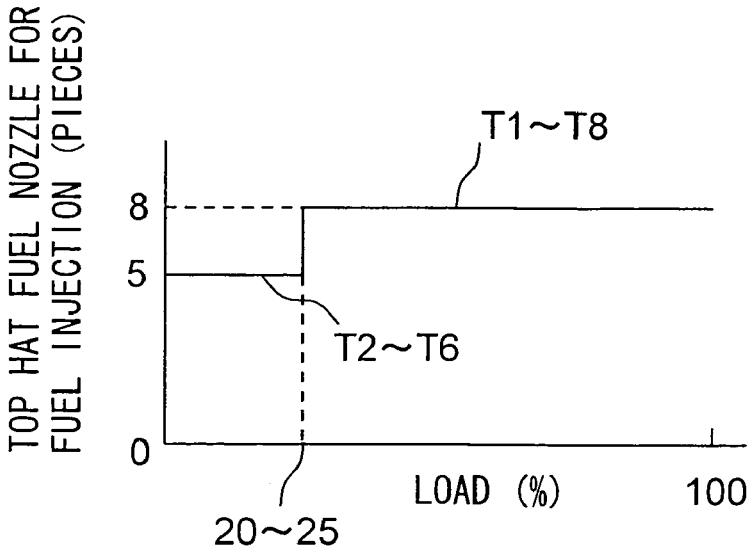

FIG. 13A and FIG. 13B are graphs showing an example of the staging of the fuel in accordance with this tenth embodiment, FIG. 13A depicts the staging of the main fuel shown in the first embodiment and FIG. 13B depicts the staging of the top hat fuel. In FIG. 13A, the axis of abscissas shows the load (%), and the axis of ordinate shows the number of the main nozzles performing combustion (in pieces). In addition, in FIG. 13B, the axis of abscissas shows the load (%),and the axis of ordinate shows the number of the top hat fuel nozzles for fuel injection (in pieces).

As shown in FIG. 13A, in the low load zone where the load is lower than 20% to 25%, combustion is performed by the five main nozzles M2 through M6, and in the partial load zone where the load is 20 to 25% or higher, combustion is performed by changing over to the eight main nozzles M1 through M8. In response to this, as shown in FIG. 13B, in the low load zone where the load is lower than 20% to 25%, the fuel is injected only from the five nozzles T2 through T6, and in the partial load zone where the load is 20 to 25% or higher, the fuel is injected from all the eight nozzles T1 through T8. In addition, the number of the top hat fuel nozzles T1 through T8 is not limited to a singular number but may be a plural number.

Eleventh Embodiment

Figure 14A:
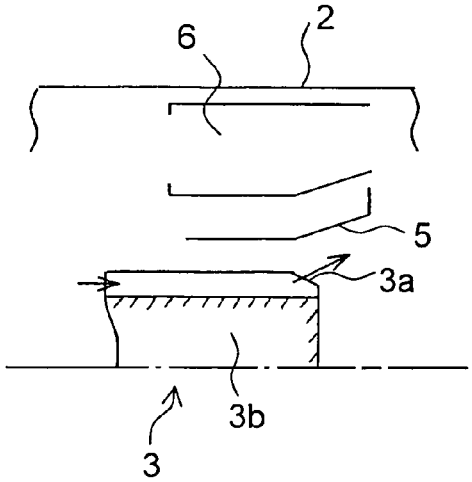
FIG. 14A and FIG. 14B are schematic longitudinal cross-sectional views showing necessary portions of a combustor of a gas turbine in accordance with an eleventh embodiment.
Figure 14B:
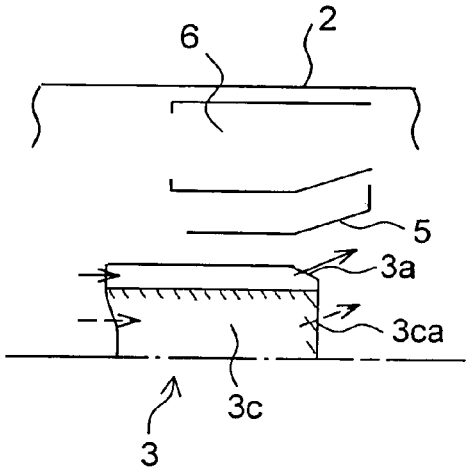

FIG. 14A and FIG. 14B are schematic longitudinal cross-sectional views showing necessary portions of a combustor of a gas turbine in accordance with the eleventh embodiment of the present invention. FIG. 14A shows the conventional construction and FIG. 14B shows the construction of this embodiment. As shown in FIG. 14A, a conventional pilot nozzle 3 has an oil nozzle 3*b* for oil injection installed to the center portion thereof for dual application for gas-fired and oil-fired gas turbines. In this case, gas fuel passes through the circumference of the oil nozzle 3*b* as shown with an arrow in a solid line and is injected from a pilot hole 3*a* in the circumference of the tip of the pilot nozzle 3.

In this embodiment, as shown in FIG. 14B, a gas nozzle 3*c* is inserted in place of the oil nozzle 3*b* and has a gas fuel pass through the inside thereof as shown with an arrow in a broken line so as to inject the gas fuel from the hole 3*ca* at the tip thereof By this, the amount of pilot gas injection is increased so as to increase the pilot fuel ratio, thereby increasing the ratio of diffusion combustion which results in reduction of the unburned portion of the fuel. This construction is applied to the zone where the load is 50% or less.

Figure 15:
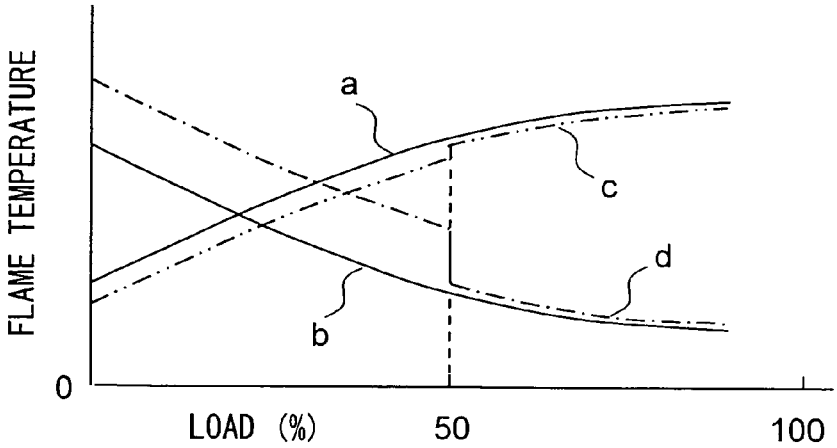
FIG. 15 is a graph showing an example of a schedule of combustion in accordance with the eleventh embodiment.

FIG. 15A is a graph showing an example of a schedule of combustion in accordance with this embodiment. In FIG. 15, the axis of abscissas shows the load (%), and the axis of ordinate shows the flame temperature. In addition, the solid line "a" in the figure shows the conventional main flame temperature, and the solid line "b" shows the conventional pilot flame temperature. Moreover, the chain double-dashed line "c" shows the main flame temperature of this embodiment, and the alternate long and short dash line "d" shows the pilot flame temperature of this embodiment.

In this embodiment, as shown in FIG. 15, due to the construction as described above, in the zone of the load of 50% or less, the main flame temperature transits to be lower than conventional, while the pilot flame temperature transits to be higher than conventional, thereby reducing the unburned portion of the fuel. In addition, in the zone of more than 50% load, because the unburned portion is scarcely produced, approximately same flame temperature as conventional is achieved without using the gas nozzle 3*c*.

Because many of the oil-fired gas turbines are for back-up use for the gas-fired turbines, most of the actual operation of the gas turbines is gas-fired. Therefore, it is good to operate a gas turbine with a gas nozzle installed for normal operation and then operate it by replacing the gas nozzle with an oil nozzle when oil-fired operation is necessary.

Twelfth Embodiment

Figure 16A:
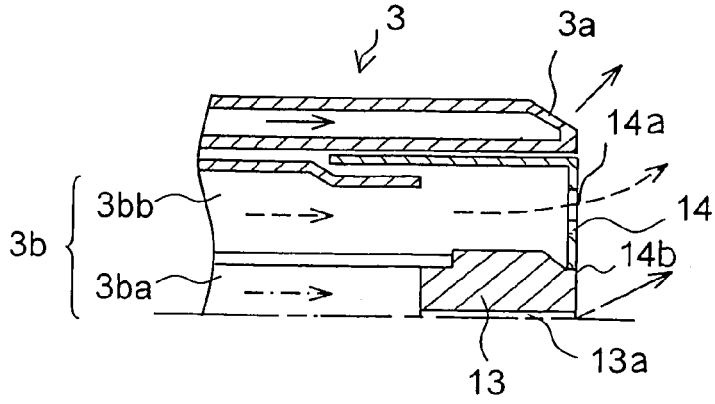
FIG. 16A and FIG. 16B are schematic longitudinal cross-sectional views showing the tip portion of a pilot nozzle of a combustor of a gas turbine in accordance with a twelfth embodiment.
Figure 16B:
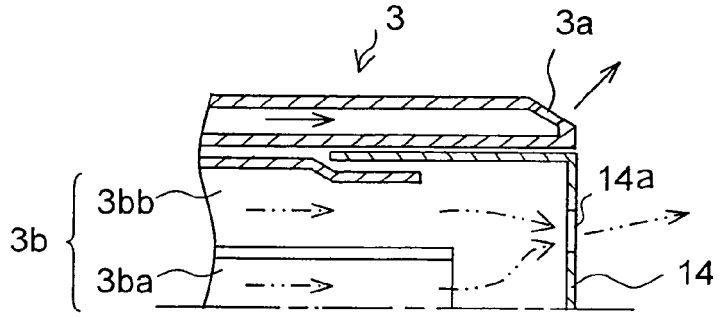

FIG. 16A and FIG. 16B are schematic longitudinal cross-sectional views showing the tip portion of the pilot nozzle of a combustor of a gas turbine in accordance with the twelfth embodiment of the present invention. FIG. 16A shows one example and FIG. 16B shows another example. As shown in FIG. 16A and FIG. 16B, in this embodiment, same as the above eleventh embodiment, the pilot nozzle 3 has an oil nozzle 3*b* installed to the center portion thereof for dual application of gas-fired and the oil-fired gas turbines. In this case, gas fuel passes through the circumference of the oil nozzle 3*b* as shown with an arrow in a solid line and is injected from a pilot hole 3*a* in the circumference of the tip of the pilot nozzle 3.

As shown in FIG. 16A, the oil nozzle 3*b* being installed to the center portion of the pilot nozzle 3 is a double tube consisting of the center portion 3*ba* and the outer circumference portion 3*bb* as conventionally constructed. In addition, an oil nozzle chip 13 is engaged into the tip of the center portion 3*ba,* and a cap 14 is installed to the outer circumference portion 3*bb,* covering the outer circumference portion of the tip of the oil nozzle chip 13. Wherein, the tip of the oil nozzle chip 13 comes out of the opening 14*b* in the center of the cap 14. A conventional cap 14 for water atomizing is installed for oil-fired operation and is replaced with a cap for fuel gas injection in accordance with this embodiment for gas-fired operation.

The pilot oil being supplied through the center portion 3*ba* during oil-fired operation as shown with an arrow in an alternate long and short dash line is injected from the hole 13*a* at the tip of the oil nozzle chip 13. In addition, the water being supplied through the outer circumference portion 3*bb* shown with an arrow in a broken line is sprayed from the hole 14*a* at the tip of the cap 14. On the other hand, during gas-fired operation, because the cap 14 is replaced with a cap for fuel gas injection as described hereinabove, fuel gas is supplied through the outer circumference portion 3*bb* as shown with an arrow in a broken line and injected from the hole 14*a* at the tip of the cap 14. In this case, in order to be used for fuel gas injection, the hole 14*a* is made larger than the hole for water atomizing, for example. In addition, during gas-fired operation, the pilot oil is stopped being supplied.

As described hereinabove, only by changing the cap at the tip of the oil nozzle, this embodiment can be applied to both gas-fired and oil-fired operations. During gas-fired operation, the amount of the pilot gas injection is increased so as to increase the ratio of the pilot fuel, thereby increasing the ratio of diffusion combustion. As a result, cost reduction can be achieved and at the same time, the unburned portion of the fuel can be reduced in the same manner as the above eleventh embodiment.

Furthermore, as shown in FIG. 16B, during gas-fired operation, the oil nozzle chip 13 can be removed to replace the cap 14 with another cap for fuel gas injection. In this case, the cap 14 does not have the above opening 14*b* but has the hole 14*a* made much larger. Then, the fuel gas is supplied through both of the center portion 3*ba* and the outer circumference portion 3*bb* of the oil nozzle 3*b* as shown with an arrow in a chain double-dashed line and injected from the hole 14*a* at the tip of the cap 14.

As constructed as shown in FIG. 16A, because the oil nozzle chip 13 is located on the central axis of the tip of the cap 14, the space in the portion thereof is slightly narrow. Therefore, by removing the oil nozzle chip as shown in FIG. 16B, the hole 14*a* at the tip of the cap 14 can be made large, thereby making it possible to inject a large amount of fuel gas. In this embodiment, only by changing the cap at the tip of the oil nozzle and removing the oil nozzle chip as described hereinabove, the unburned portion of the fuel can be reduced in the same manner as the above eleventh embodiment, aiming at cost reduction at the same time.

Thirteenth Embodiment

Figure 17:
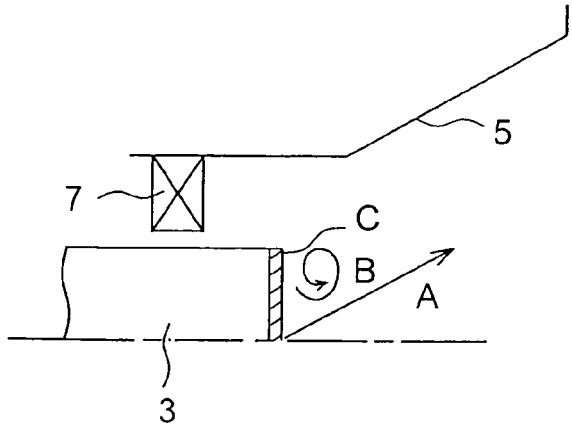
FIG. 17 is a schematic longitudinal cross-sectional view showing the tip portion of a pilot nozzle of a combustor of a gas turbine in accordance with a thirteenth embodiment.

FIG. 17 is a schematic longitudinal cross-sectional view showing the apical end of the pilot nozzle of a combustor of a gas turbine in accordance with the thirteenth embodiment. In this embodiment, as shown in FIG. 17, the apical surface of the pilot nozzle 3 is supplied with catalyst coating "C." During oil-fired operation, when the pilot oil is sprayed from the tip of the pilot nozzle 3 as shown with an arrow "A," a circulation zone is formed in front of the pilot nozzle 3 as shown with an arrow "B," and smoke is generated in this portion. Therefore, by burning this smoke by action of the above catalyst coating "C," the unburned portion of the fuel can be reduced.

What is claimed is:

1. A combustor of a gas turbine including:

a pilot nozzle installed at a center of a combustor basket;

a plurality of main nozzles installed around the pilot nozzle with each main nozzle provided with pre-mixers on the outer circumference thereof;

a plurality of pilot holes formed in the pilot nozzle so as to respectively correspond to each of the main nozzles;

first top hat fuel nozzles for supplying the main nozzles with fuel; and second top hat fuel nozzles arranged downstream of the first top hat fuel nozzles, wherein pilot fuel is respectively injected from the pilot holes to the main nozzle to generate a diffusion flame in a transition piece, main fuel is injected into the transition piece as an air fuel mixture, the main fuel is ignited by the diffusion flame in a transition piece to generate a premixed flame in the transition piece.

2. A staging method of a combustor of a gas turbine, the combustor including a pilot nozzle installed at a center of a combustor basket, and a plurality of main nozzles installed around the pilot nozzle with each main nozzle provided with pre-mixers on the outer circumference thereof, the method comprising the steps of:

performing combustion by using part of the plurality of main nozzles from start-up of the combustor until a load rate of the combustor approaches a predetermined value; and executing combustion by adding the remaining main nozzles when the load rate of the combustor exceeds the predetermined value; wherein at substantially the time that the load rate of the combustor exceeds the predetermined value, an amount of a total fuel supplied to the combusting main nozzles, even with the added remaining nozzles, is maintained uniformly so that the amount of the total main fuel supply is not changed.

3. The staging method of the combustor of the gas turbine as described in claim 2, wherein when the load rate of the combustor exceeds the predetermined load rate, combustion is performed by adding the remaining main nozzles one by one in accordance with an increase in load.

4. The staging method of the combustor of the gas turbine as described in claim 2, wherein fuel is injected from pilot holes formed in the pilot nozzle corresponding to each of the main nozzles, in response to combustion being performed by each of the main nozzles.

5. The staging method of the combustor of the gas turbine as described in claim 2, wherein fuel is supplied to the pilot nozzle from second top hat fuel nozzles arranged on the downstream side of an air flow of existing top hat fuel nozzles for supplying pilot fuel to the main nozzles with fuel.

6. The staging method of the combustor of the gas turbine as described in claim 5, wherein fuel is injected from the existing top hat fuel nozzles responding to combustion being performed by each of the main nozzles.

7. The staging method of the combustor of the gas turbine as described in claim 2, wherein a cross section of a short axis side of the remaining main nozzles is smaller than a cross section of a short axis side of the main nozzles that is used until the load rate of the combustor exceeds the predetermined load rate, when the load rate of the combustor exceeds the predetermined load rate, the combustion is performed by adding the remaining main nozzles which is arranged at a side of a bypass elbow.

* * * * *